United States Patent [19]

Yoshida

[11] Patent Number: 4,831,834

[45] Date of Patent: May 23, 1989

[54] METHOD OF PROTECTING A REFRIGERATING APPARATUS

[75] Inventor: Kazuhiro Yoshida, Toyoake, Japan

[73] Assignee: Hoshizaki Electric Co., Ltd., Toyoake, Japan

[21] Appl. No.: 179,219

[22] Filed: Apr. 8, 1988

[30] Foreign Application Priority Data

Apr. 13, 1987 [JP] Japan ..... 62-54762[U]

[51] Int. Cl.[4] ..... F25B 49/00; F25D 21/06

[52] U.S. Cl. ..... 62/156; 62/126; 62/129; 62/228.1

[58] Field of Search ..... 62/156, 278, 196.4, 62/226, 227, 228.1, 228.3, 126, 129; 417/32, 292

[56] References Cited

U.S. PATENT DOCUMENTS 2,811,019 10/1957 Courtney, Jr. ..... 417/32
4,328,678 5/1982 Kono et al. ..... 62/126
4,602,485 7/1986 Fujimoto et al. ..... 62/278 X

FOREIGN PATENT DOCUMENTS 55-162571 12/1980 Japan .

*Primary Examiner*—Harry B. Tanner
*Attorney, Agent, or Firm*—Wenderoth, Lind & Ponack

[57] ABSTRACT

A refrigerating apparatus includes a compressor, a condenser, an expansion valve and an evaporator interconnected in that order. A hot gas bypass pipeline with a solenoid valve is connected at one end between the compressor and the condenser and at the other end between the expansion valve and the compressor. A temperature detecting switch detects a temperature of the piping between the discharge side of the evaporator and the intake side of the compressor. The temperature at which the detection switch can respond is set at a predetermined value at which no influence is exerted on components of the apparatus formed of thermoplastic resin. When the temperature at the intake side of the compressor rises to the predetermined value, the detecting switch detects this predetermined value to cause the compressor to stop operating.

3 Claims, 1 Drawing Sheet

METHOD OF PROTECTING A REFRIGERATING APPARATUS

BACKGROUND OF THE INVENTION

1. Field of the Invention

The present invention relates generally to a refrigerating apparatus such as a refrigerator, ice making machine, cooled showcase or the like in which a defrosting and/or deicing operation is carried out by the use of hot gas. More particularly, the present invention is concerned with a method of protecting a refrigerating apparatus at the time when hot gas is flowing through a hot gas bypass pipeline incorporated in the refrigerating apparatus.

2. Description of the Prior Art

Heretofore, various proposals have been made in conjunction with the protection of a refrigerating circuit or refrigerating unit of a refrigerating apparatus. As a typical one of such proposals, a protection apparatus is disclosed in Japanese Patent Application Laid-Open No. 162571/1980 (JP-A-55-162571). In this known protection apparatus, the temperature of the casing of a compressor is detected for producing an abnormality alarm or for stopping the operation of the compressor when the detected temperature has attained a predetermined value, so as to prevent the compressor from being overheated due to a decrease of the coolant in the refrigerating unit brought about by leakage thereof. The hitherto known protection apparatus including the abovementioned type can accomplish the intended function in a satisfactory manner so far as the protection of the compressor is concerned, which is so to speak, the heart of the refrigerating unit. In recent years, however, there has been a tendency to increasingly use synthetic resin as the material constituting various parts of the refrigerating unit, whose ability to withstand heat is poor when compared to metal. In this connection, it must be noted that the heretofore known protection apparatus can not ensure adequate protection for parts made of synthetic resin.

For a better understanding of the present invention, description will be made of the problems of the prior art in more concrete terms by referring to FIG. 1 of the accompanying drawings. As is well known, in the course of operation of a refrigerating apparatus of the type mentioned above, a normal refrigerating cycle repetitively alternates with a defrosting cycle in which a hot gas produced by the compressor is directly introduced into an evaporator by way of a hot gas bypass pipeline for periodically removing frost and ice deposited on the evaporator. In FIG. 1, a curve $T_a$ represents changes in the temperature of an intake pipe of the compressor during the course of the repetitive cycles mentioned above, and a curve $T_b$ represents changes in the temperature of the casing of a compressor. As is readily understood by those skilled in the art, the intake pipe temperature $T_a$ of the compressor is lowered over time t during the refrigerating cycle during normal operation, while the compressor casing temperature $T_b$ is increased. On the other hand, during the defrosting cycle, the compressor intake pipe temperature $T_a$ increases over time with the compressor case temperature $T_b$ being decreased.

A solenoid valve is installed in the hot gas bypass pipeline. By closing the solenoid valve, the operation of the refrigerating apparatus is changed over from the defrosting cycle mode to the refrigerating cycle mode.

Under certain circumstances, when a failure occurs in a control circuit for controlling the opening/closing operation of the solenoid valve or when an abnormality such as jamming occurs in the solenoid valve itself due to foreign material or particles, the solenoid valve may remain unclosed thereby causing the refrigerating apparatus to abnormally continue the defrosting cycle, whereby the hot gas continues to flow into the evaporator, resulting in the temperature $T_a$ on the low-pressure side of the refrigerating unit (i.e. the compressor intake pipe temperature) steeply increasing, accompanied by a rapid increase in the temperature of the evaporator.

The temperature $T_b$ of the compressor casing tends to increase beyond the temperature $T_a$ of the compressor intake pipe under the influence of heat generated by the compressor driving motor as well as the heat carried by the exhaust gas. The highest temperature that the casing of the reciprocating compressor can withstand is usually to about 80° C. Accordingly, the temperature $T_{b1}$ at which the temperature detecting switch for detecting the temperature $T_b$ of the compressor casing can respond for protecting the refrigerating circuit is usually set at a value not higher than 80° C. Accordingly, when the solenoid valve is prevented from closing for the reasons mentioned above to thereby allow the hot gas to continue to flow into the evaporator, the temperature $T_a$ of the compressor intake conduit will rise to a level $T_{a1}$ (about 70° C.) shown in FIG. 1 at the time when the temperature detecting switch can respond to the increased temperature $T_{b1}$ of the compressor casing, resulting in the temperature of the evaporator becoming higher than the temperature $T_{a1}$, as has been confirmed experimentally. Needless to say, the evaporator is the cooling source for the refrigerator as well as the ice making machine and is installed within a housing. Consequently, if the evaporator is heated to a high temperature, those parts made of thermoplastic resin materials such as, for example, ABS resin, vinyl chloride or the like and which are disposed in the vicinity of the evaporator, such as typified by the inner fittings of a refrigerator or the water tank of an ice maker, may undergo thermal deformation or melting in extreme cases, resulting in fatal damage to the refrigerating apparatus, even when no abnormality takes place in the refrigerating unit. In the worst case, the above-described phenomenon may lead to a fire.

In order to prevent such accidents by resorting to the use of the protection apparatus described above, it is necessary that the protection apparatus be able to operate without fail before the evaporator of the refrigerating unit installed at the low-pressure side of the compressor has been heated to the dangerously high temperature mentioned above. To this end, the temperature at which the temperature detecting switch mounted on the casing of the compressor can respond has to be set at a low level such as, for example, $T_{b2}$ rather than $T_{b1}$. In that case, however, the function of the protection apparatus may be triggered even when the refrigerating circuit operates normally, giving rise to problems with respect to the reliability of the protection apparatus and degradation in the operation efficiency of the refrigeration apparatus.

In this way, the hitherto known protection mechanism operating based on the detected temperature of the compressor casing is incapable of dealing with abnormal temperature rises occurring at the low-pressure side of the refrigerating unit when the hot gas defrosting cycle is extended for some reason, without involving additional problems.

SUMMARY OF THE INVENTION

A protection method according to the invention is intended to be applied to a refrigerating apparatus which comprises a refrigerating unit including a compressor, a condenser provided at the discharge side of the compressor, expansion means provided at the outlet side of the condenser and an evaporator disposed between the expansion means and the intake side of the compressor, wherein the refrigerating unit is provided with a hot gas bypass pipeline having one end connected between the discharge side of the compressor and the inlet side of the condenser and the other end connected between the outlet side of the expansion means and the intake side of the compressor, the hot gas bypass pipeline being provided with a solenoid valve. In the refrigerating cycle, the solenoid valve is closed, whereby the coolant delivered by the compressor flows into the evaporator by way of the condenser and the expansion means to cool down the evaporator. In the defrosting cycle, the solenoid valve is opened to cause the hot gas discharged from the compressor to flow into the evaporator by way of the hot gas bypass pipeline for removing frost or ice.

According to the present invention, a temperature detecting switch is provided to detect a temperature of a pipeline interconnected between the outlet side of the evaporator and the intake (low pressure) side of the compressor. The temperature at which the temperature switch can respond is set at a predetermined value at which no adverse influence is exerted on the parts of the refrigerating apparatus that are formed of thermoplastic resin. If, for example, the solenoid valve remains unclosed for some reason at the end of the defrosting cycle, the temperature at the intake side of the compressor will then rise rapidly to a predetermined temperature level. This temperature level is detected by the temperature detecting switch, whereby the operation of the compressor is stopped. It should be noted that the temperature of the compressor casing is lower than a permissible level ($T_{b1}$ in FIG. 1) at the time when the temperature at the intake side of the compressor has attained the predetermined temperature level mentioned above. Thus, the compressor itself can be protected against being overheated.

BRIEF DESCRIPTION OF THE DRAWING

A preferred embodiment of the invention will now be described, by way of example only, with reference to the accompanying drawings, in which.

DETAILED DESCRIPTION OF THE PREFERRED EMBODIMENT

Figure 2:
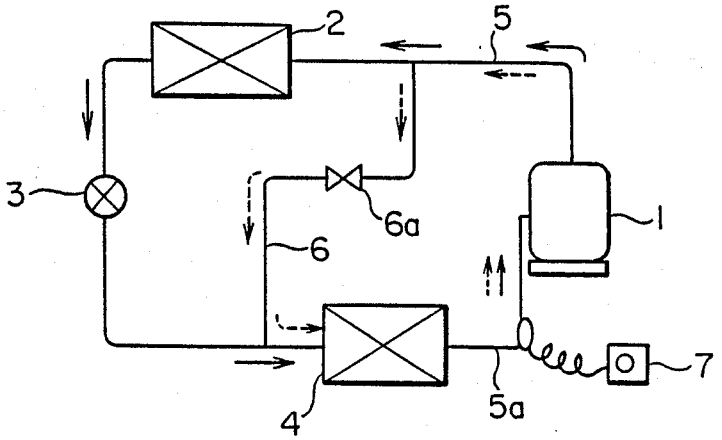
FIG. 2 is a schematic diagram showing a general arrangement of a refrigerating unit to which a monitoring and protecting method according to the invention can be applied.

Referring to the drawings and more particularly to FIG. 2, there is shown schematically a general arrangement of a refrigerating unit of a refrigerating apparatus to which the protection method according to the invention can be applied. As is well known in the art, in the refrigerating unit including a compressor 1, a condenser 2, a throttle valve or expansion device 3 and an evaporator 4 are connected by means of a pipeline 5 in this order as viewed from the high-pressure or discharge side of the compressor 1. Additionally, a hot-gas bypass pipeline 6 is provided in the refrigerating unit, which bypass pipeline 6 has one end connected to the pipeline 5 between the discharge side of the compressor 1 and the inlet side of the condenser 2 and the other end connected to the pipeline 5 between the outlet side of the throttle device 3 and the intake side of the compressor 1. This bypass pipeline is provided with a solenoid valve **6*a* which is closed during the refrigerating cycle and opened during the defrosting cycle, as is known in the art and described hereinafter. Furthermore, a temperature detecting switch 7 is provided in the pipeline 5*a* between the outlet side of the evaporator 4 and the intake side of the compressor 1**.

Figure 1:
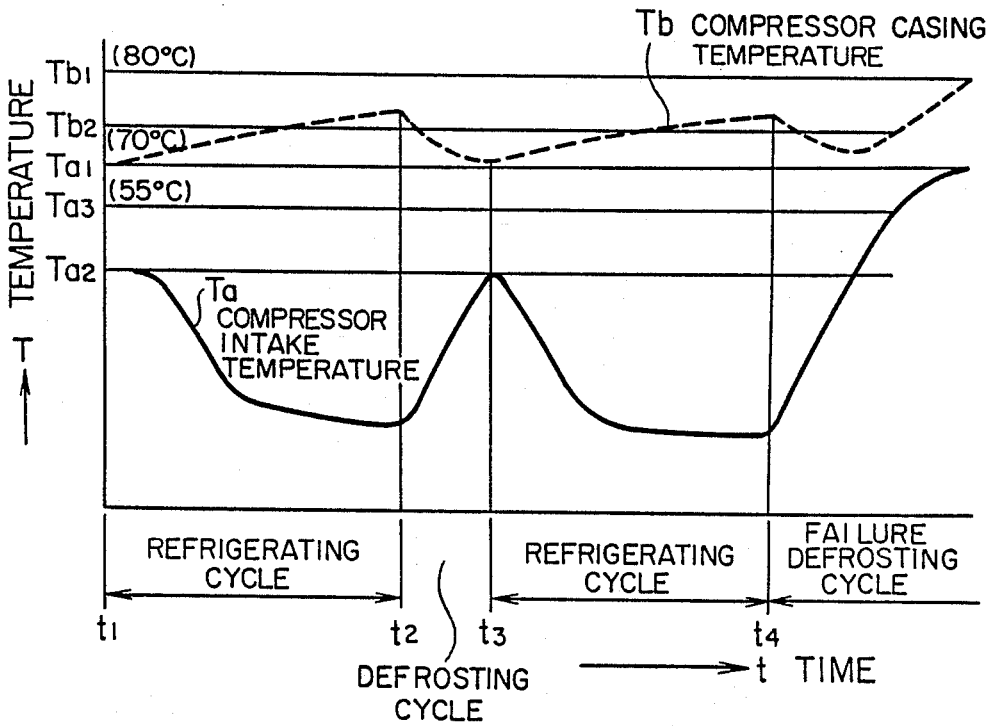
FIG. 1 is a graph illustrating a relationship between the temperature of the casing of a compressor and the temperature at the intake side of the compressor during operation of a refrigerating apparatus.

The temperature detecting switch 7 serves not only for protecting the refrigerating apparatus but also for indicating the completion of the defrosting cycle. When the temperature at the intake side of the compressor 1 has attained a defrosting completion temperature, i.e. a first low temperature $T_{a2}$ (see FIG. 1) at the end of the defrosting cycle, the temperature detection switch 7 detects the first low temperature $T_{a2}$, whereupon a control circuit (not shown) of the refrigerating apparatus to which the temperature detecting switch 7 is connected produces a valve closing signal for closing the solenoid valve **6*a***.

In the refrigerating unit having the structure described above, the solenoid valve **6*a* installed in the bypass pipeline 6 is closed during the refrigerating cycle. Thus, the coolant flows, as indicated by solid line arrows, through the refrigerating unit from the compressor 1 by way of the condenser 2 and the throttle device 3 into the evaporator 4 where the coolant is evaporated to cool down the evaporator 4**.

During the defrosting cycle, the solenoid valve **6*a* is opened. Thus, hot gas flows, as indicated by broken line arrows, through the refrigerating unit directly into the evaporator 4 by way of the bypass pipeline 6 without flowing through the condenser 2 to thereby heat the evaporator, as a result of which the frost and ice deposited on the evaporator 4 are removed. When the temperature of the pipeline 5a increases progressively as the defrosting and deicing proceeds within the evaporator 4 and attains the first low temperature $T_{a2}$, the temperature detecting switch 7 detects this low temperature $T_{a2}$ which indicates the completion of the detecting cycle, whereupon the solenoid valve 6a** is closed to complete the defrosting cycle.

If the solenoid valve **6*a* is prevented from being closed for some reason upon the completion of the abovementioned defrosting cycle, then the defrosting cycle continues to be effective even when the temperature of the pipeline 5*a* has attained the first low temperature $T_{a2}$. Consequently, the temperature of the pipeline 5*a* rises beyond the first low temperature $T_{a2}$ to ultimately attain a second predetermined high temperature $T_{a3}$ (FIG. 1) which may be set at 55° C., by way of example. The temperature detecting switch 7 provided in the pipeline 5*a* according to the present invention detects this high temperature $T_{a3}$, whereupon the control circuit (not shown) responds to the output of the detecting switch 7** to thereby stop the operation of the compressor.

As will be appreciated from the foregoing description, the temperature rise at the low-pressure side of the refrigerating unit in an abnormal defrosting cycle can be detected without being influenced by the motor temperature and/or the exhaust gas temperature of the compressor, whereby a rapid and reliable protection of the compressor can be accomplished. Furthermore, because the low-pressure side of the refrigerating unit can be protected from a high temperature in addition to the compressor itself being protected, the parts used in the refrigerating apparatus that are made of resin, which has inherently poor heat resistance can also be protected from high temperatures.

It is understood that the invention and many of its attendant advantages will be apparent from the foregoing description and it that various changes may be made in the form, construction and arrangement thereof without departing from the spirit and scope of the invention or sacrificing all of its material advantages, the form hereinbefore described being merely a preferred or exemplary embodiment thereof.

What I claim is:

1. A method of protecting a refrigerating apparatus having a refrigerating unit defining a refrigeration circuit along which refrigerant circulates, the refrigerating unit including a compressor in the circuit, a condenser connected in the circuit to the discharge side of the compressor, refrigerant expansion means connected in the circuit at the outlet side of the condenser, an evaporator connected in the circuit between the expansion means and the intake side of the compressor, and a hot gas bypass including a solenoid valve, the hot gas bypass connected at one end thereof in the circuit between the discharge side of the compressor and the inlet side of the condenser and at the other end thereof between the outlet side of the expansion means and the intake side of the compressor, said method comprising:

operatively connecting a temperature detecting switch, capable of detecting temperature and responding to a predetermined temperature detected thereby, to the circuit at a location between the outlet side of the evaporator and the intake side of the compressor to detect the temperature at said location;

setting said temperature detecting switch to respond to a first predetermined temperature at which parts of the refrigerating apparatus are not adversely affected; and stopping the operation of the compressor whenever said temperature detecting switch responds to the temperature at said location reaching said first predetermined temperature.

2. A method of protecting a refrigerating apparatus as claimed in claim 1, wherein said step of setting further includes setting the temperature detecting switch to also respond to a second predetermined temperature that is lower than said first predetermined temperature, and said method further comprising closing said solenoid valve based on the response of said temperature detecting switch occurring when the temperature detected by the switch at said location reaches said second predetermined temperature.

3. A method of protecting a refrigerating apparatus having a refrigerating unit defining a refrigeration circuit along which refrigerant circulates, the refrigerant unit including a compressor in the circuit, a condenser connected in the circuit to the discharge side of the compressor, refrigerant expansion means connected in the circuit at the outlet side of the condenser, an evaporator connected in the circuit between the expansion means and the intake side of the compressor and having thermoplastic parts connected thereto, and a hot gas bypass including a solenoid valve, said hot gas bypass connected at one end thereof in the circuit between the discharge side of the compressor and the inlet side of the condenser and at the other end thereof between the outlet side of the expansion means and the intake side of the compressor, said method comprising:

operatively connecting a temperature detecting switch, capable of detecting temperature and responding to a predetermined temperature detected thereby, to the circuit at a location between the outlet side of the evaporator and the intake side of the compressor to detect the temperature at said location;

setting said temperature detecting switch to respond to a first predetermined temperature at which the thermoplastic parts connected to the evaporator will not thermally deform; and stopping the operation of the compressor based on the response of said temperature detecting switch occurring when the temperature detected at said location by the switch reaches said first predetermined temperature.

* * * * *